US008651164B2

(12) United States Patent
Klish et al.

(10) Patent No.: US 8,651,164 B2
(45) Date of Patent: Feb. 18, 2014

(54) METHOD FOR VERTICAL ACTING EGRESS AND FIRE/SMOKE PROTECTION

(75) Inventors: Ian Klish, Nanticoke, PA (US); Brian Reklaitis, Pittston, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 112 days.

(21) Appl. No.: 13/034,096

(22) Filed: Feb. 24, 2011

(65) Prior Publication Data

US 2012/0216462 A1 Aug. 30, 2012

(51) Int. Cl.
*E05F 15/20* (2006.01)

(52) U.S. Cl.
USPC ..... 160/7; 160/1; 160/9

(58) Field of Classification Search
USPC ..... 160/8, 7, 405, 310, 9, 1, 300, 301; 318/452
See application file for complete search history.

(56) References Cited

U.S. PATENT DOCUMENTS

| | | | | | |
|---|---|---|---|---|---|
| 1,275,168 | A * | 8/1918 | McCloud | 160/8 |
| 1,332,942 | A * | 3/1920 | Brunst | 160/8 |
| 2,038,523 | A * | 4/1936 | Cahill | 160/7 |
| 3,685,567 | A * | 8/1972 | Pemberton et al. | 160/8 |
| 4,130,156 | A * | 12/1978 | Wardlaw | 160/9 |
| 4,147,197 | A * | 4/1979 | Bailey et al. | 160/7 |
| 5,134,347 | A * | 7/1992 | Koleda | 318/16 |
| 5,203,392 | A * | 4/1993 | Shea | 160/7 |
| 5,228,492 | A * | 7/1993 | Jou | 160/188 |
| 5,253,693 | A * | 10/1993 | Marlatt et al. | 160/7 |
| 5,576,581 | A * | 11/1996 | Iannuzzi et al. | 307/117 |
| 5,850,865 | A * | 12/1998 | Hsieh | 160/310 |
| 5,896,907 | A * | 4/1999 | Dever et al. | 160/6 |
| 6,155,324 | A * | 12/2000 | Elliott et al. | 160/1 |
| 6,484,784 | B1 * | 11/2002 | Weik et al. | 160/7 |
| 7,138,912 | B2 * | 11/2006 | Fitzgibbon et al. | 340/521 |
| 7,299,847 | B1 * | 11/2007 | Evans | 160/1 |
| 7,878,230 | B2 * | 2/2011 | Daus et al. | 160/9 |
| 8,069,896 | B2 * | 12/2011 | Magro | 160/1 |
| 8,397,787 | B1 * | 3/2013 | Daus et al. | 160/9 |
| 2008/0250716 | A1 | 10/2008 | Ranaudo et al. | |
| 2010/0115853 | A1 * | 5/2010 | Gebhart et al. | 49/506 |
| 2010/0242364 | A1 | 9/2010 | Magro | |
| 2010/0243175 | A1 | 9/2010 | Gonzales et al. | |
| 2011/0282496 | A1 * | 11/2011 | Hsu | 700/275 |

FOREIGN PATENT DOCUMENTS

KR 10-2010-0012670 2/2010

* cited by examiner

*Primary Examiner* — Katherine Mitchell
*Assistant Examiner* — Johnnie A Shablack
(74) *Attorney, Agent, or Firm* — Mitchell A. Smolow

(57) ABSTRACT

The present invention presents a novel alternative to side-hinged swinging doors that offers access to a broad egress opening width needed to meet higher occupancy egress requirements while simultaneously qualifying as a fire/smoke barrier. In a preferred embodiment, a single overhead coiling fire door shaft assembly is counter-balanced to allow a fire door curtain to automatically close at a governed controlled descent upon reaching an established critical low battery condition. An operator is provided that will run the door under both normal condition and during a power failure or fire/smoke condition at an established average door speed, and also provide established levels of low battery warning signals/actions while also providing the ability to open as required for emergency egress until the temperature at the opening is not conducive for human life.

30 Claims, 10 Drawing Sheets

METHOD FOR VERTICAL ACTING EGRESS AND FIRE/SMOKE PROTECTION

FIELD OF THE INVENTION

This invention relates generally to emergency egress, and in particular, to a method of creating vertical acting emergency egress with simultaneous fire/smoke barrier protection.

BACKGROUND OF THE INVENTION

By code, buildings such as industrial, school and public buildings require fire and smoke barrier opening protectives. They also require emergency egress capability. Due to the simplistic operation and known designs of swing door exit hardware, side-hinged swinging doors are commonly used to simultaneously accomplish both.

However, code rated side-hinged swinging doors are not always the desired design choice to meet code requirements. For structures needing higher occupancy load egress and fire/smoke protection requirements, multiple swing doors and/or banks of swing doors and their associated frame assemblies are used. The framing requirements of multiple doors and/or banks of doors present architectural challenges for building designers.

In an attempt to overcome these challenges, a variety of door designs have been developed. One known design uses up to two swinging tire door and frame assemblies that store in pockets perpendicular to the opening. A second known design includes a bank of swinging fire door and frame assemblies that are attached to the bottom of a coiling door. Although these designs include commonly accepted side-hinge swinging doors, they require significantly more head or side room clearances and cost more to manufacture than earlier designs.

Another known design uses commonly accepted side-hinge swinging doors in an accordion folding fire door configuration. However, this design requires side stack space for the folded accordion door and non-folding side-hinge swinging door(s). Because occupancy load determines the amount of door opening/number of required doors, each required side-hinge swinging door mandates additional side stack space, thereby reducing the overall free space and presenting construction challenges.

Another known design uses accordion folding fire doors with an integral DC power supply and curtain mounted egress activation hardware that causes electric opening of the door for egress. The speed of clearing the opening must be coordinated with the building occupant load and required egress opening width within 10 seconds of egress hardware activation. These doors mandate ample side room to store the accordion folding fire door and operating system Accordingly, there remains a continuing need for improved combined emergency egress and fire/smoke barrier designs. The present invention fulfills this need and further provides related advantages.

BRIEF SUMMARY OF THE INVENTION

The present invention presents a novel alternative to side-hinged swinging doors and offers access to a broad egress opening width needed to meet higher occupancy egress requirements while simultaneously qualifying as a fire/smoke barrier.

A single overhead coiling fire door is provided with an operator that will run the door under both normal condition and during a power failure or fire/smoke condition at an established average door speed, and also provide established levels of low battery warning signals/actions while also providing the ability to open as required for emergency egress. In a preferred embodiment, an overhead coiling fire door shaft assembly is counter-balanced to allow a fire door curtain to automatically close at a governed controlled descent upon reaching an established critical low battery condition.

Such configurations allow building designers the ability to reduce the construction costs and aesthetic problems associated with numerous banks of fire/emergency egress doors.

Another advantage is the ability to provide more open occupancy space.

Yet another advantage is the elimination of side-hinged swing door mullions and header construction, thereby allowing for unobstructed paths of egress.

When compared to pocket width requirements for horizontal sliding egress fire doors and head room requirements for rolling doors with attached side-hinged swinging doors, the present disclosure requires minimal head and side room clearances.

Still another advantage is that the doors can remain fully out of egress paths during normal conditions, thereby providing fewer tendencies with which to be tampered. Side-hinged swing doors can get blocked or wedged in the open position.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
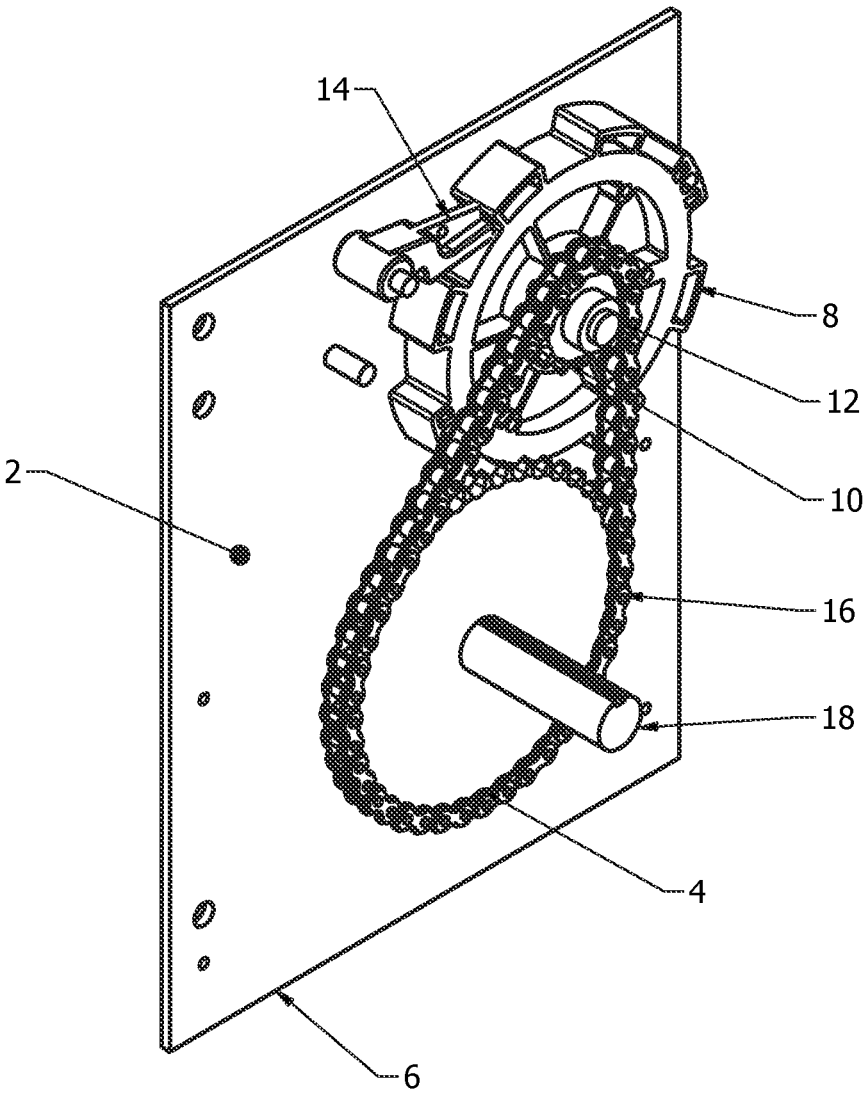
FIG. 1 is an isometric view of the spring release mechanism depicting the governor and sprockets.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

In a preferred embodiment, an overhead coiling door upon receiving a first alarm signal enters a first alarm state, causing a door operator to close the overhead coiling door curtain under power within a pre-established time. If emergency egress is required, upon activation of an egress device, the operator causes the door curtain to open to a pre-established opening height, pause for a pre-established period of time to allow emergency egress and then reclose if still in the first alarm state. Once the alarm signal is cleared, causing the first alarm state to end, the door curtain is reset to the fully open position by user activation of an "open" control circuit.

The operator is, for example, a DC operator with a self-contained power cell (battery) to run the door under normal conditions and power failure. The door's power cell is continually charged while AC power is present and provides for standby power during an AC power failure. The operator is capable of running on AC power if the power cell is not present.

The door curtain may be reset to the fully open position by user activation of an "open" control circuit once the first alarm signal is cleared. Optionally, the door curtain may be set to automatically open to the fully open position after the first alarm state is cleared.

The above sequence utilizes power operation of the operator. Battery backup is provided to power the operator during electrical grid power failure. However, to meet established safety requirements, emergency egress must also be available during a battery underpowered or non-powered state.

The operator provides varying levels of low battery warning signals and actions.

In a non-alarm state, during an initial Level 1 low battery condition, a warning, for example, an audible warning and/or a warning output signal at a terminal strip connection is generated. The audible signal is designed to be heard outside the operator enclosure. During a Level 1 battery condition the operator is capable of full functionality. The audible warning signal and warning output signal allow for corrective intervention prior to an alarm condition.

If corrective intervention is not taken, and battery power continues to decrease, at a pre-established low battery power rating, a Level 2 low battery condition is entered, whereupon the operator power operates to position the door curtain to a pre-established egress opening height, for example, to a 96" opening height, while the audible warning and/or terminal strip output signals continue. An alarm signal state during a Level 2 battery condition will cause the door to power close.

During a Level 2 low battery condition, adequate battery power remains for the operator to power open the door to the pre-established egress height upon an egress device or "open" button activation and pause for a pre-established time sufficient to allow emergency egress, before the operator powers the door to re-close.

If battery power continues to degrade, at a pre-established minimum battery level, a Level 3 battery condition is entered. During a Level 3 battery condition, sufficient battery power remains for the operator to power operate the door to a pre-established egress opening height, for example, to a 96" opening height and then release the operator clutch/motor drive. A counter balance, for example, a spring counter-balance, is set such that the door will stay at the egress opening height.

When the battery recharges to a normal level of operation, that is above that of a Level 1 condition, the operator reengages the clutch/motor drive and returns to normal operation.

Because the door will not be able to be power operated during a Level 3 battery condition, the battery should be properly maintained to prevent entering a Level 3 battery condition. The audible warning and warning output signal are used to aid in proper battery maintenance.

As discussed above, powered emergency egress operation is activated from either side of the door opening by, for example, a wall mounted push button station or by a hands free method of activation. Egress device activation will initiate power opening of the door during normal, Level 1 and Level 2 conditions. An obstruction sensing edge device is used to react to doorway obstructions during power closing of the door to prevent damage to the door or objects or injury to incapacitated persons lying beneath the door curtain.

For example, full length light curtains can be used to act as both the egress activation control and as opening obstruction sensors. Consecutive breaks of the light curtains can be programmed to reset a door closing timer to its pre-established time delay, thereby allowing for multiple individuals to exit before the door begins to re-close.

The sequences described above allow for fire/smoke barrier operation during normal, Level 1 and Level 2 battery conditions. Powered emergency egress has been described for normal, Level 1, and Level 2 battery conditions.

Powered emergency egress is not appropriate for a Level 3 battery condition. During a Level 3 battery condition, emergency egress is obtained by monitoring the battery condition and programmatically positioning the door to an egress opening height. If battery warning signals are ignored and the operating system reaches a Level 3 battery condition, the operating system will power the door to a pre-established egress opening height, for example, to a 96" opening height to provide egress and release the clutch/motor drive to provide egress. The door is counter-balanced to remain open.

In order to provide fire protection at the opening during a Level 3 battery condition a high temperature limit trip sensor, for example, to trip at a temperature not conducive to human life, for example, from about 165° F. to about 500° F., will when tripped prevent power operation and release spring tension. Once tripped by a high temperature sensor at the opening, an open door will gravity close to provide fire protection. The fire door system will require manual resetting once the high temperature sensor trips. A fire rated enclosure protects the operator up to the high temperature limit. A closing speed governor is fabricated into the door or operator and is functionally independent of the operator drive clutch release.

Turning now to the figures, a novel spring release mechanism for releasing the clutch/motor drive during a Level 3 condition is presented. An advantage of this novel clutch/motor drive is its ability to allow for only limited spring tension release, the remaining tension reduced enough to allow the door curtain to gravity close.

FIG. 1 depicts the spring release mechanism 2 which comprises a large sprocket 4 rotationally fixed to a shaft 18 arising from inner bracket 6. A governor 8, for example, a viscous governor, comprises a small sprocket 10 rotationally fixed to the governor 8, but free to rotate on stud 12. The viscous governor 8, is operatively engaged by first ratcheting pawl 14 which is attached to inner bracket 6. Large sprocket 4 and small sprocket 10 are operatively engaged, for example, by chain 16. The viscous governor is used to limit spring release speed.

Figure 2:
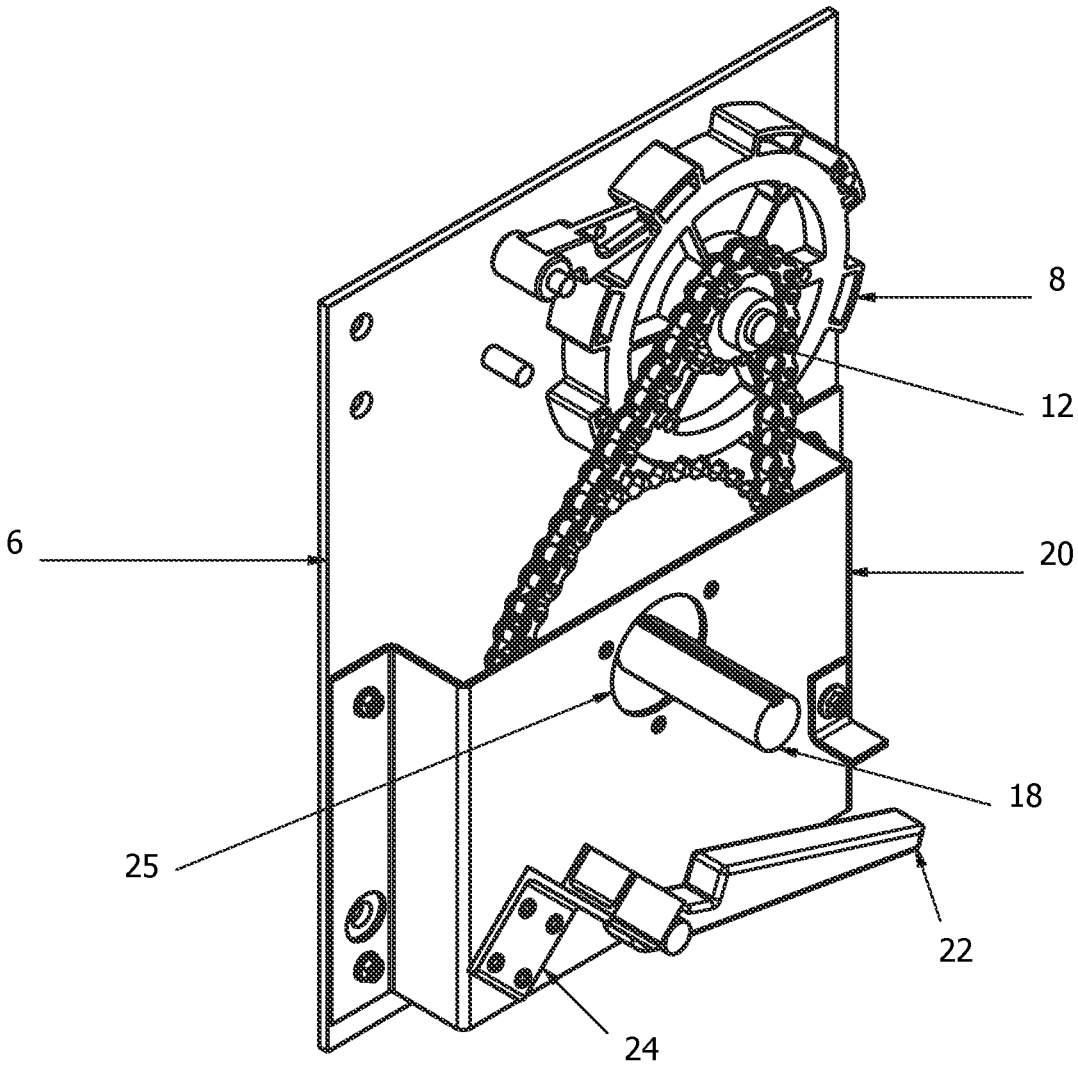
FIG. 2 is an isometric view of the spring release mechanism with the outer bracket, drop out pawl and swing arm stop.
Figure 3:
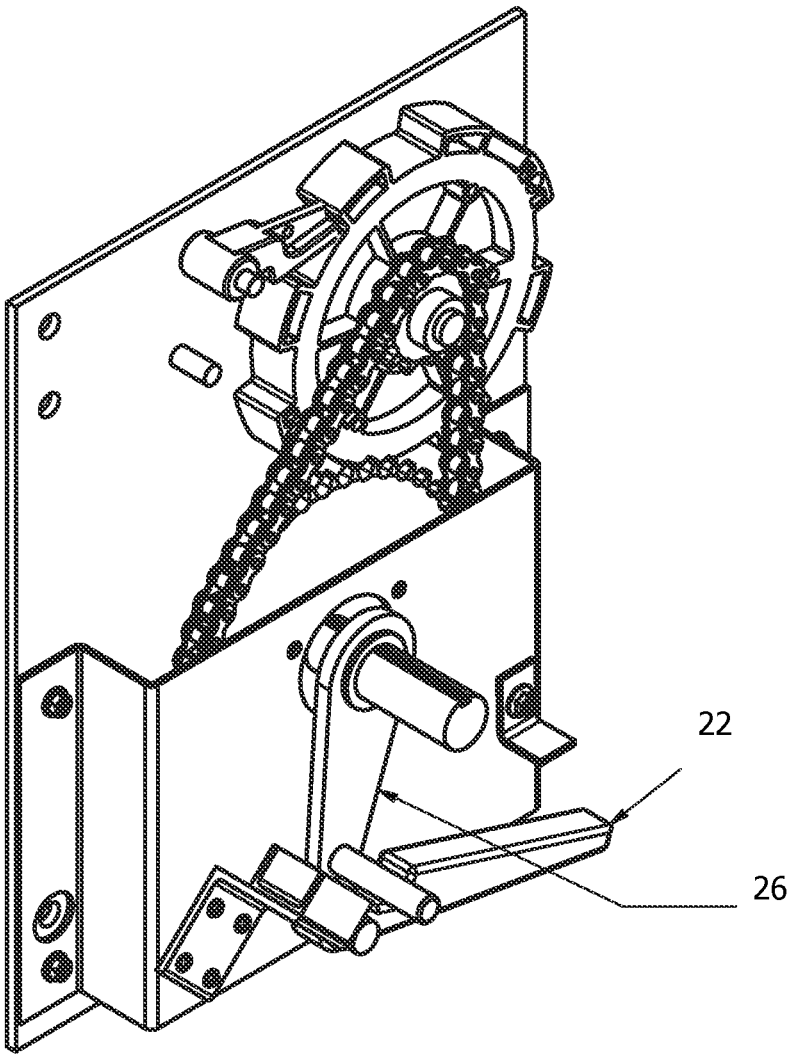
FIG. 3 is an isometric view of the spring release mechanism of FIG. 2 further depicting the swing arm.
Figure 4:
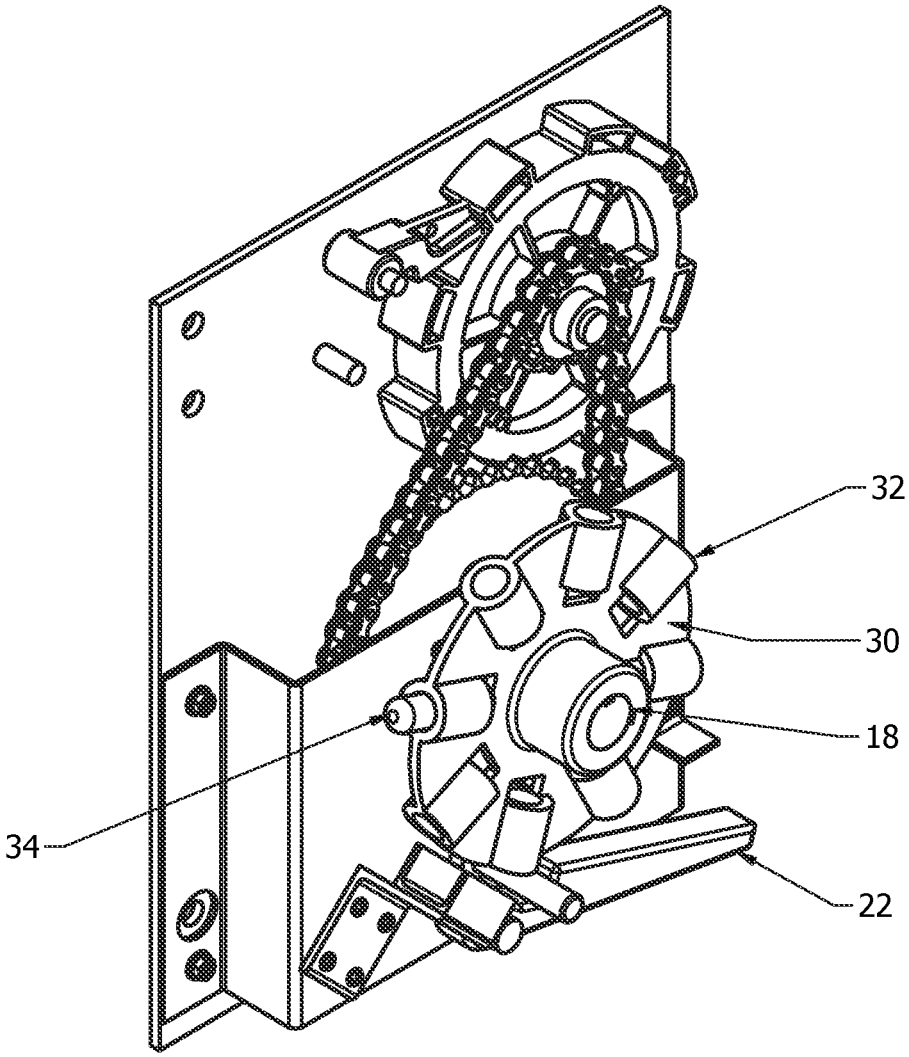
FIG. 4 is an isometric view of the spring release mechanism of FIG. 3 further depicting the adjusting wheel and pin.
Figure 5:
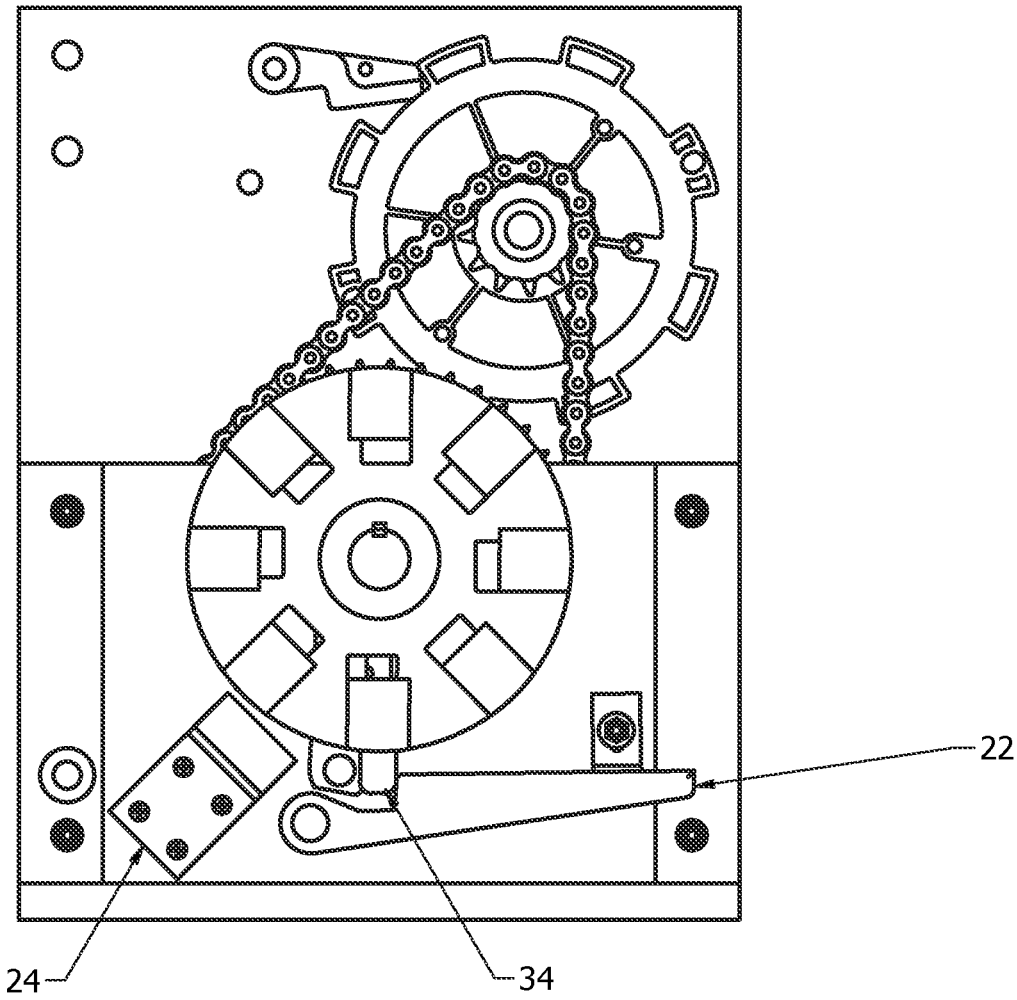
FIG. 5 is a front view of the spring release mechanism with the pin engaged.
Figure 6:
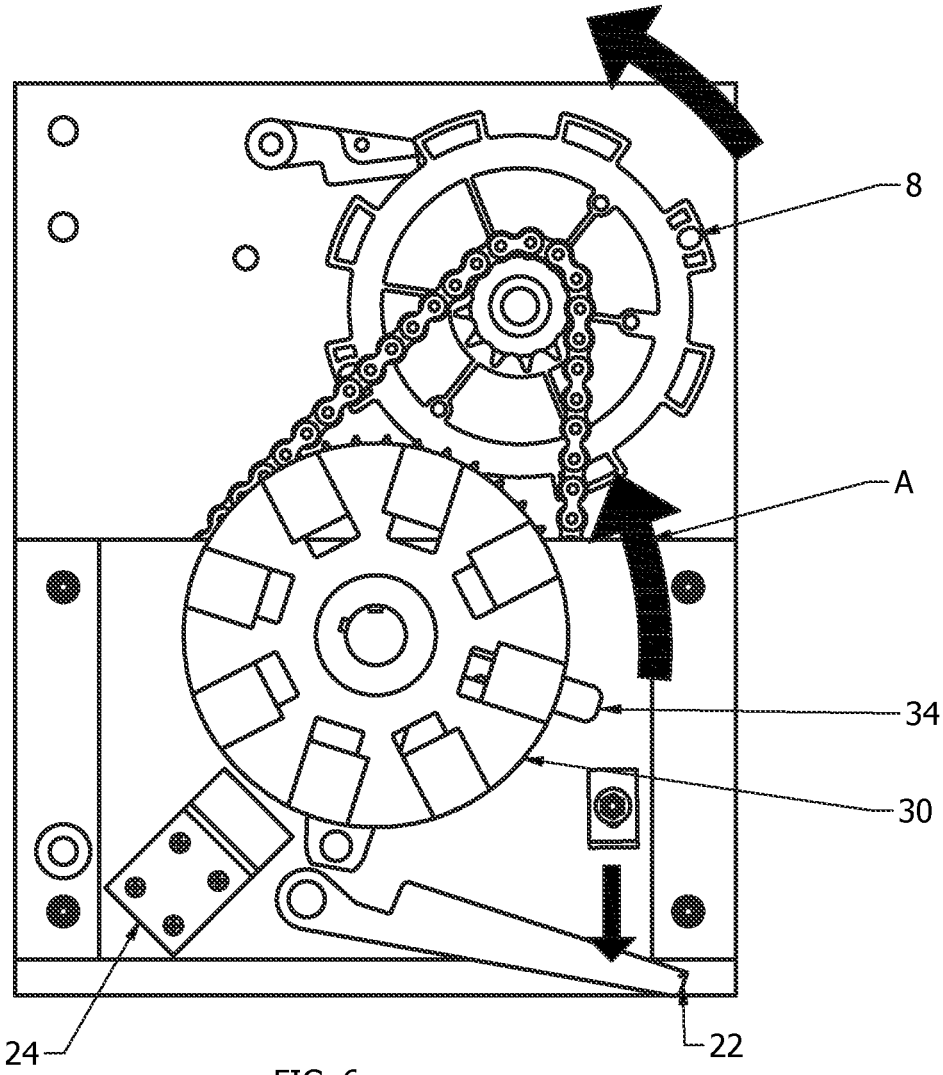
FIG. 6 is a front view of the spring release mechanism with the pin disengaged.

FIGS. 2-4 depict an outer bracket 20 which is attached to inner bracket 6 and comprises a dropout pawl 22 and a swing arm stop 24. Shaft 18 extends through outer bracket orifice 25 to rotationally receive swing arm 26. Swing arm 26 is rotationally restricted by engagement with dropout pawl 22. An adjusting wheel 30 rotatively engages shaft 18 and comprises multiple receptacles 32 for receiving pin 34 and a tensioning tool (not shown) used to tension the counter balance spring (not shown).

Turning now to FIGS. 5-11, in use, the release operates as follows. The tension of the counter balance spring is set as required by inserting the tensioning tool (not shown) into receptacles 32 and rotating the adjusting wheel in known fashion to tension the spring (not shown). The tensioned spring is maintained in a tensioned position by lifting the dropout pawl 22 to engage the pin 34 which has been inserted into a receptacle 32 on the rotationally forward side of swing arm 26. Rotation direction is designated by arrow A, FIG. 6.

The dropout pawl 22 is maintained in an engaged position by, for example, a sash chain connected to a fusible link (not shown). Upon activation of the fusible link, for example, upon reaching a predetermined high heat ambient temperature, the dropout pawl 22 will drop from the engaged position, releasing the pin 34. Spring tension causes the adjusting wheel 30 to move freely in the direction shown by arrow A. The governor 8 will act to moderate the rotational velocity of the assembly, and by operative connection, the door curtain, thereby preventing excessive door curtain closing spend and permanent damage.

Figure 7A:
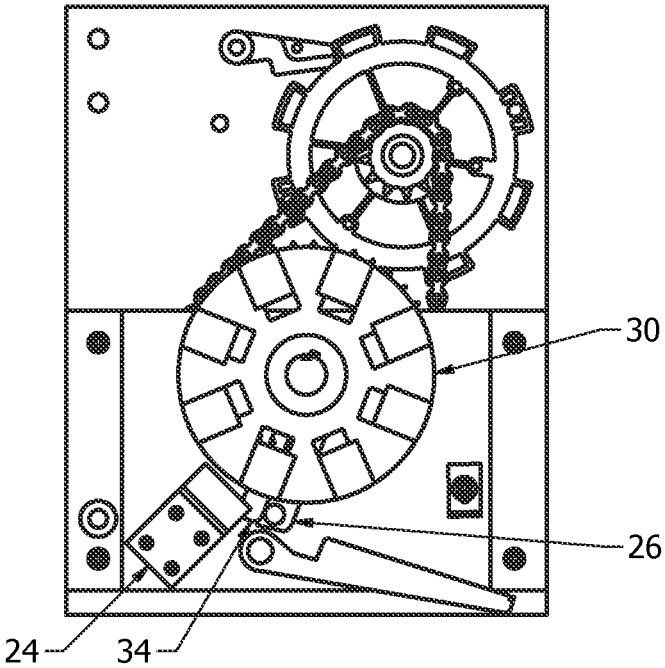
FIG. 7A is a front view of the spring release mechanism depicting the swing arm stop channel.
Figure 7B:
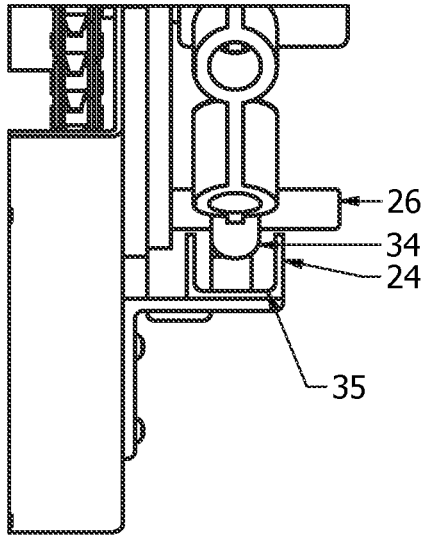
FIG. 7B is a side view of the spring release mechanism depicting the swing arm stop channel.
Figure 8:
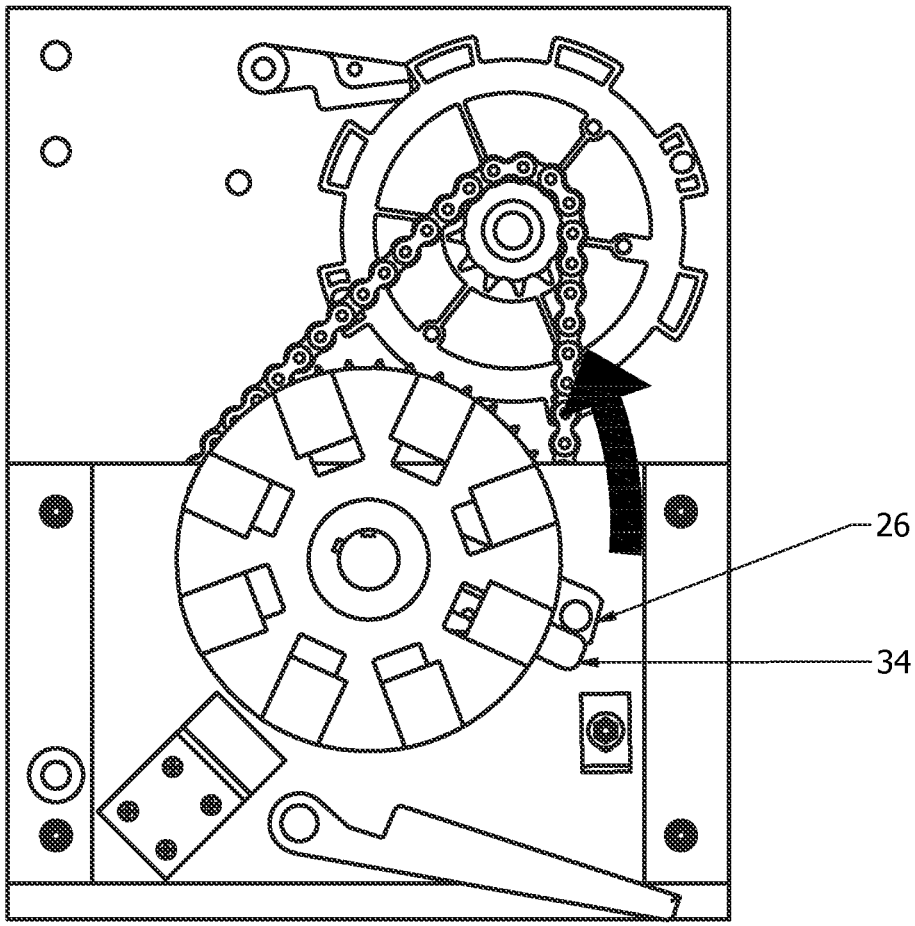
FIG. 8 is a front view of the spring release mechanism with the engaged pin and swing arm.
Figure 9A:
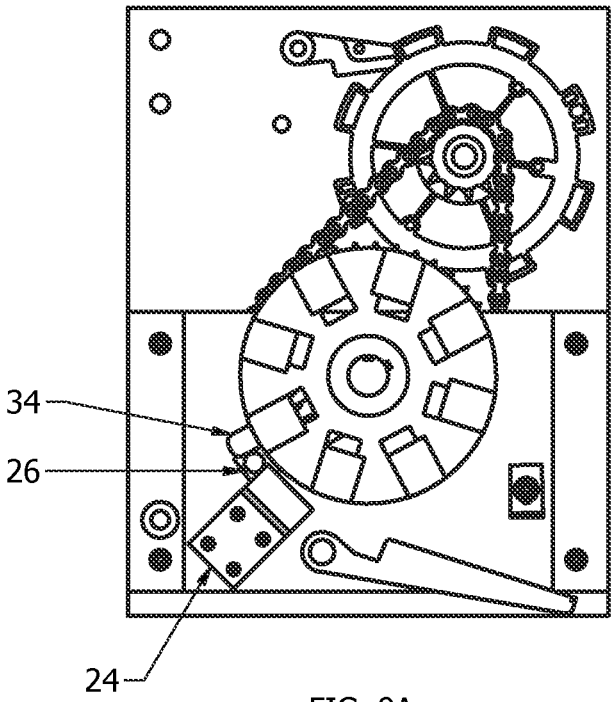
FIG. 9A is a front view of the spring release mechanism with the engaged pin, swing arm, and swing arm stop.
Figure 9B:
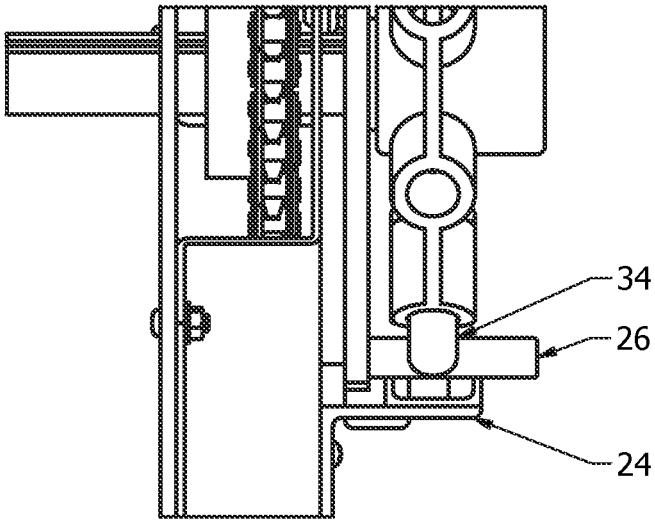
FIG. 9B is a side view of the spring release mechanism with the engaged pin, swing arm, and swing arm stop.

As depicted in FIGS. 7A and 7B, when adjusting wheel 30 rotates, the pin 34 will pass through the channel 35 of the swing arm stop 24 and engages swing arm 26 just prior to attaining one complete rotation of adjusting wheel 30. As the spring tension continues to turn adjusting wheel 30, the engaged swing arm 26 rotates until it is stopped by engagement with the swing arm stop 24, effectively stopping further release of the spring tension (FIGS. 9A and 9B). In this fashion, the adjusting wheel 30 rotates beyond one full revolution before being stopped, thereby allowing sufficient spring tension release to allow the door curtain to gravity close, yet not allow release of all spring tension.

Figure 10:
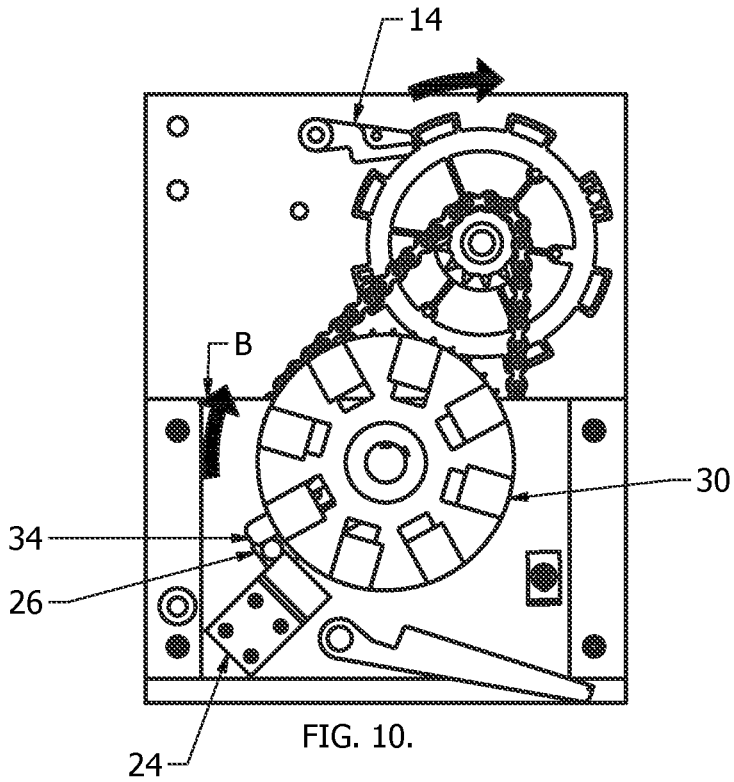
FIG. 10 is a front view of the spring release mechanism depicting the re-tensioning direction.
Figure 11:
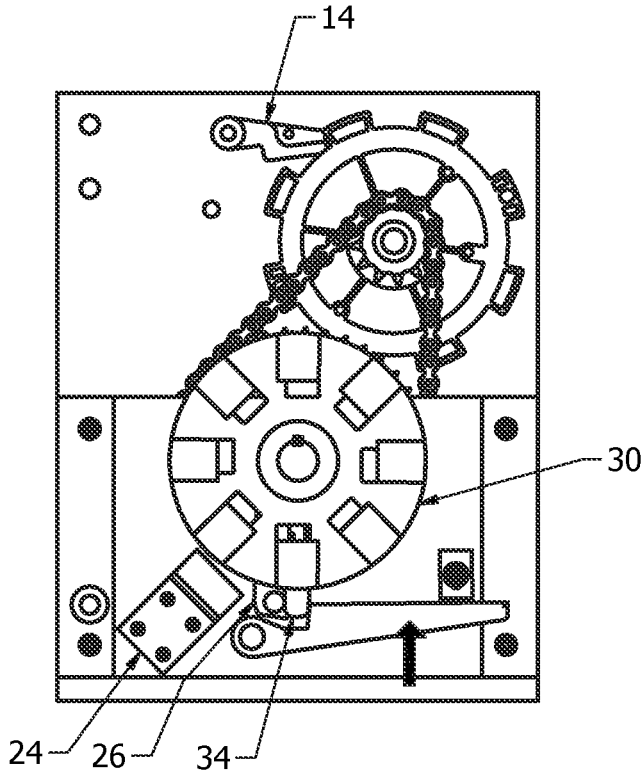
FIG. 11 is a front view of the spring release mechanism after re-tensioning.

FIGS. 10 and 11 depict the spring release mechanism retensioned by rotating the adjusting wheel 30 in the reverse direction, indicated by arrow B, until the swing arm 26 engages the opposite side of the swim arm stop 24. The dropout pawl 22 is then lifted to re-engage the pin 34, thereby once again preventing adjusting wheel 30 from rotating, and thereby preventing the door curtain (not shown) from gravity induced free fall.

The ratcheting feature of the governor 8, using ratcheting pawl 14 allows the governor 8 to engage the ratcheting pawl 14 when the spring tension is being released, thus not impeding the installation process. This ratcheting feature also acts as a safety feature to engage the governor 8 if the installer were to lose their grip while adding turns to the adjusting wheel 30, thereby preventing component damage and decreasing the risk of injury.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A method for providing vertical acting egress and fire and smoke protection using an overhead coiling door comprising the steps of:

power closing the door to a closed position upon entering an alarm state;

while still in the alarm state power opening the door to a pre-established emergency egress height upon activation of an egress device, pausing for a pre-established period of time, and reclosing; and returning to a fully open position once the alarm state ends;

wherein the door is powered by an operator powered by a self-contained power cell and an additional operator logic having a normal power cell condition, a Level 1 low power cell condition, a Level 2 low power cell condition, and a Level 3 low power cell condition;

wherein the Level 1 low power cell condition comprises a power cell condition below the normal power cell condition wherein the operator functions as if in the normal power cell condition;

the Level 2 low power cell condition comprises a power cell condition below the Level 1 low power cell condition wherein the door power closes when in the alarm state; and power operates to the emergency egress height upon activation of the egress device pauses for a pre-established period of time, and recloses while still in the alarm state;

the Level 3 low power cell condition comprises a power cell condition below the Level 2 low power cell condition wherein the operator moves the door to the emergency egress height and releases an operator clutch and motor drive, wherein a preset counter balance operatively connected to the door balances the door at the emergency egress height; and wherein upon activation of a predetermined temperature high temperature limit trip sensor, prevents power operation and releases spring tension moving the door to a fully closed position by gravity;

wherein the operator reengages the clutch and motor drive when the power cell returns to a normal power cell condition and the predetermined temperature high temperature limit trip sensor did not activate; and wherein spring tension is released by a spring release mechanism comprising:

a first sprocket rotationally fixed to a shaft arising from an inner bracket;

a governor comprising a second sprocket rotationally fixed to the governor and operatively engaging the first sprocket, the governor operatively engaged by a first ratcheting pawl attached to the inner bracket;

an outer bracket attached to the inner bracket;

a dropout pawl attached to the outer bracket comprising a pin/swing arm engagement area;

a swing arm stop attached to the outer bracket comprising a channel to allow pass through of a pin;

a shaft operatively connected to the first sprocket extending through an outer bracket orifice to rotationally receive a swing arm, the swing arm rotationally restricted by engagement with the dropout pawl pin and swing arm engagement area; and a tensioned adjusting wheel rotatively engaged to the shaft comprising a plurality of receptacles to receive the pin.

2. The method of claim 1 wherein an alarm signal causes the door to enter into the alarm state.

3. The method of claim 1 wherein the power cell is continually charged while AC power is present.

4. The method of claim 1 wherein the door returns to the fully open position after the alarm state is cleared.

5. The method of claim 1 further comprising the step of resetting the pre-established period of time to allow for multiple individuals to exit before the door begins to reclose.

6. The method of claim 1 further comprising an operatively connected closing speed governor functionally independent of the operator clutch and motor drive release.

7. The method of claim 1 wherein a warning is generated during a non-alarm state Level 1 low power cell condition.

8. The method of claim 7 wherein the warning is used to aid in power cell maintenance.

9. The method of claim 1 further comprising an operatively connected obstruction sensing device to halt power closing of the door upon activation.

10. The method of claim 9 wherein the sensing device acts as both the egress device and the obstruction sensing device.

11. A vertical acting egress comprising a door and a powered operator wherein:

the door power closes to a closed position upon entering an alarm state;

while still in the alarm state the door power opens to a pre-established emergency egress height upon activation of an egress device, pausing for a pre-established period of time, and reclosing; and the door returns to a fully open position once the alarm state ends;

wherein the door is powered by the operator powered by a self-contained power cell and an additional operator logic having a normal power cell condition, a Level 1 low power cell condition, a Level 2 low power cell condition, and a Level 3 low power cell condition;

wherein the Level 1 low power cell condition comprises a power cell condition below the normal power cell condition wherein the operator functions as if in the normal power cell condition;

the Level 2 low power cell condition comprises a power cell condition below the Level 1 low power cell condition wherein the door power closes when in the alarm state; and power operates to the emergency egress height upon activation of the egress device pauses for a pre-established period of time, and recloses while still in the alarm state;

the Level 3 low power cell condition comprises a power cell condition below the Level 2 low power cell condition wherein the operator moves the door to the emergency egress height and releases an operator clutch and motor drive, wherein a preset counter balance operatively connected to the door balances the door at the emergency egress height; and wherein upon activation of a predetermined temperature high temperature limit trip sensor, prevents power operation and releases spring tension moving the door to a fully closed position by gravity;

wherein the operator reengages the clutch and motor drive when the power cell returns to a normal power cell condition and the predetermined temperature high temperature limit trip sensor did not activate; and wherein spring tension is released by a spring release mechanism comprising:

a first sprocket rotationally fixed to a shaft arising from an inner bracket;

a governor comprising a second sprocket rotationally fixed to the governor and operatively engaging the first sprocket, the governor operatively engaged by a first ratcheting pawl attached to the inner bracket;

an outer bracket attached to the inner bracket;

a dropout pawl attached to the outer bracket comprising a pin and swing arm engagement area;

a swing arm stop attached to the outer bracket comprising a channel to allow pass through of a pin;

a shaft operatively connected to the first sprocket extending through an outer bracket orifice to rotationally receive a swing arm, the swing arm rotationally restricted by engagement with the dropout pawl pin and swing arm engagement area; and a tensioned adjusting wheel rotatively engaged to the shaft comprising a plurality of receptacles to receive the pin.

12. The vertical acting egress of claim 11 wherein an alarm signal causes the door to enter into the alarm state.

13. The vertical acting egress of claim 11 wherein the power cell is continually charged while AC power is present.

14. The vertical acting egress of claim 11 wherein the door returns to the fully open position after the alarm state is cleared.

15. The vertical acting egress of claim 11 further comprising the step of resetting the pre-established period of time to allow for multiple individuals to exit before the door begins to reclose.

16. The vertical acting egress of claim 11 further comprising an operatively connected closing speed governor functionally independent of the operator clutch and motor drive release.

17. The vertical acting egress of claim 11 wherein a warning is generated during a non-alarm state Level 1 low power cell condition.

18. The vertical acting egress of claim 17 wherein the warning is used to aid in power cell maintenance.

19. The vertical acting egress of claim 11 further comprising an operatively connected obstruction sensing device to halt power closing of the door upon activation.

20. The vertical acting egress of claim 19 wherein the sensing device acts as both the egress device and the obstruction sensing device.

21. A method for providing vertical acting egress and fire and smoke protection using an overhead coiling door comprising the steps of:

power closing the door to a closed position upon entering an alarm state;

while still in the alarm state power opening the door to a pre-established emergency egress height upon activation of an egress device, pausing for a pre-established period of time, and reclosing; and returning to a fully open position once the alarm state ends;

wherein the door is powered by an operator powered by a self-contained power cell and an additional operator logic having a normal power cell condition, a Level 1 low power cell condition, a Level 2 low power cell condition, and a Level 3 low power cell condition;

wherein the Level 1 low power cell condition comprises a power cell condition below the normal power cell condition wherein the operator functions as if in the normal power cell condition;

the Level 2 low power cell condition comprises a power cell condition below the Level 1 low power cell condition wherein the door power closes when in the alarm state; and power operates to the emergency egress height upon activation of the egress device pauses for a pre-established period of time, and recloses while still in the alarm state;

the Level 3 low power cell condition comprises a power cell condition below the Level 2 low power cell condition wherein the operator moves the door to the emergency egress height and releases an operator clutch and motor drive, wherein a preset counter balance operatively connected to the door balances the door at the emergency egress height; and wherein upon activation of a predetermined temperature high temperature limit trip sensor, prevents power operation and releases spring tension moving the door to a fully closed position by gravity;

wherein the operator reengages the clutch and motor drive when the power cell returns to a normal power cell condition and the predetermined temperature high temperature limit trip sensor did not activate.

22. The method of claim 21 wherein the power cell is continually charged while AC power is present.

23. The method of claim 21 wherein a warning used to aid in power cell maintenance is generated during a non-alarm state Level 1 low power cell condition.

24. The method of claim 21 further comprising an operatively connected obstruction sensing device acting as both the egress device and the obstruction sensing device halts power closing of the door upon sensing device activation.

25. The method of claim 21 further comprising an operatively connected closing speed governor functionally independent of the operator clutch and motor drive release.

26. A vertical acting egress comprising a door and a powered operator wherein:

the door power closes to a closed position upon entering an alarm state;

while still in the alarm state the door power opens to a pre-established emergency egress height upon activation of an egress device, pausing for a pre-established period of time, and reclosing; and the door returns to a fully open position once the alarm state ends;

wherein the door is powered by the operator powered by a self-contained power cell and an additional operator logic having a normal power cell condition, a Level 1 low power cell condition, a Level 2 low power cell condition, and a Level 3 low power cell condition;

wherein the Level 1 low power cell condition comprises a power cell condition below the normal power cell condition wherein the operator functions as if in the normal power cell condition;

the Level 2 low power cell condition comprises a power cell condition below the Level 1 low power cell condition wherein the door power closes when in the alarm state; and power operates to the emergency egress height upon activation of the egress device pauses for a pre-established period of time, and recloses while still in the alarm state;

the Level 3 low power cell condition comprises a power cell condition below the Level 2 low power cell condition wherein the operator moves the door to the emergency egress height and releases an operator clutch and motor drive, wherein a preset counter balance operatively connected to the door balances the door at the emergency egress height; and wherein upon activation of a predetermined temperature high temperature limit trip sensor, prevents power operation and releases spring tension moving the door to a fully closed position by gravity;

wherein the operator reengages the clutch and motor drive when the power cell returns to a normal power cell condition and the predetermined temperature high temperature limit trip sensor did not activate.

27. The vertical acting egress of claim 26 wherein the power cell is continually charged while AC power is present.

28. The vertical acting egress of claim 26 wherein a warning used to aid in power cell maintenance is generated during a non-alarm state Level 1 low power cell condition.

29. The vertical acting egress of claim 26 further comprising an operatively connected obstruction sensing device acting as both the egress device and the obstruction sensing device halts power closing of the door upon sensing device activation.

30. The vertical acting egress of claim 26 further comprising an operatively connected closing speed governor functionally independent of the operator clutch and motor drive release.

* * * * *